United States Patent [19]

Yale

[11] 4,089,418

[45] May 16, 1978

[54] RETURNABLE MAIL ENVELOPE

[76] Inventor: Robert S. Yale, 1660-A Avon Pl., NW., Washington, D.C. 20007

[21] Appl. No.: 772,108

[22] Filed: Feb. 25, 1977

[51] Int. Cl.[2] ..... B65D 27/32; B65D 27/06

[52] U.S. Cl. ..... 206/632; 229/71; 229/73

[58] Field of Search ..... 229/71, 73, 92.3; 206/632

[56] References Cited

U.S. PATENT DOCUMENTS

| | | | |
|---|---|---|---|
| 877,330 | 1/1908 | Harvey | 229/73 |
| 1,145,935 | 7/1915 | Steinke | 229/73 |
| 1,199,131 | 9/1916 | Waggener | 229/73 |
| 3,113,716 | 12/1963 | Howard | 229/73 |
| 3,270,948 | 9/1966 | Donovan | 229/73 |
| 3,558,040 | 1/1971 | Krueger | 229/73 |

FOREIGN PATENT DOCUMENTS

| | | | |
|---|---|---|---|
| 808,706 | 2/1937 | France | 229/92.3 |
| 640,797 | 7/1950 | United Kingdom | 229/73 |

*Primary Examiner*—Stephen P. Garbe
*Attorney, Agent, or Firm*—Bacon & Thomas

[57] ABSTRACT

A rectangular envelope formed from a single sheet of paper has a front panel with a window and foldable flaps on each edge. A first enclosure in the envelope has an address visible through the window and three of the flaps hold the enclosure in place and are loosely held in place while the fourth flap overlies the other three and is temporarily adhered, for mailing. For return mailing, after the first enclosure has been removed, the fourth flap is folded against the front panel and a return address on the fourth flap is visible through the window. A second enclosure is placed against the fourth flap and the other three flaps are folded to enclose it and the outer one of them is then permanently adhered to an edge of the fourth flap to close the envelope for return mailing.

2 Claims, 8 Drawing Figures

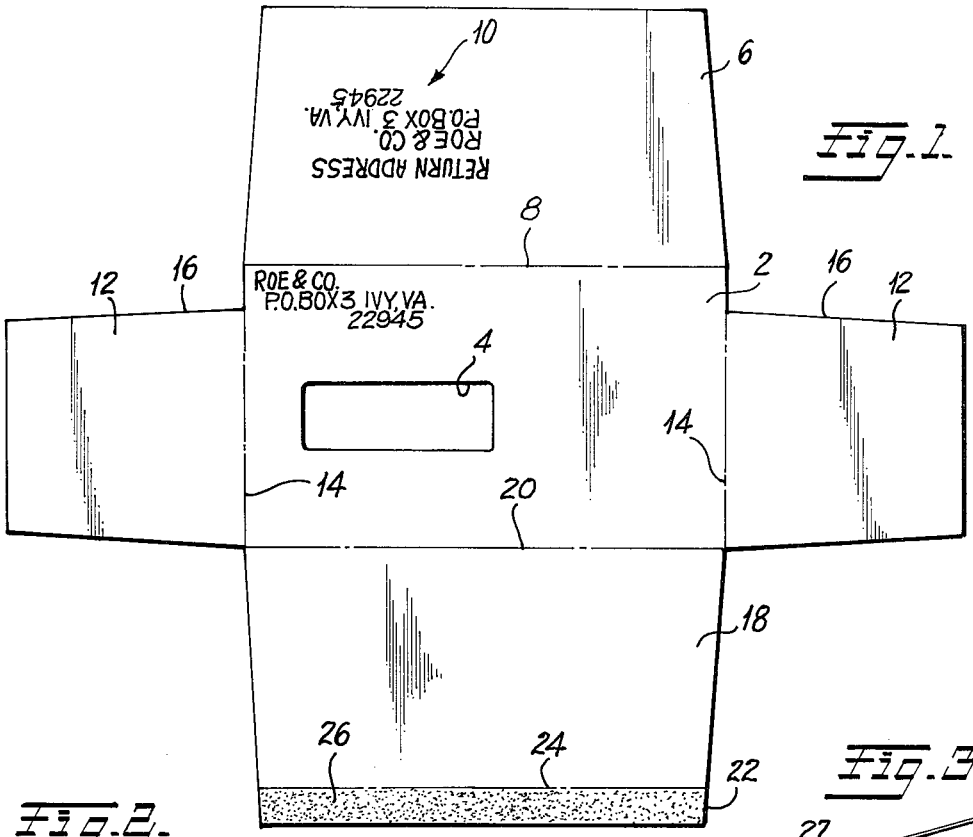
Fig. 1.
Fig. 2.
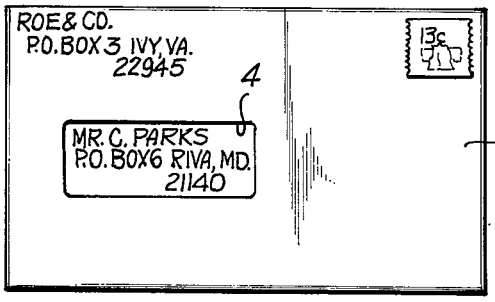
Fig. 3.
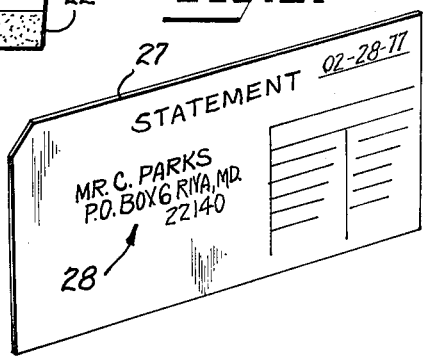
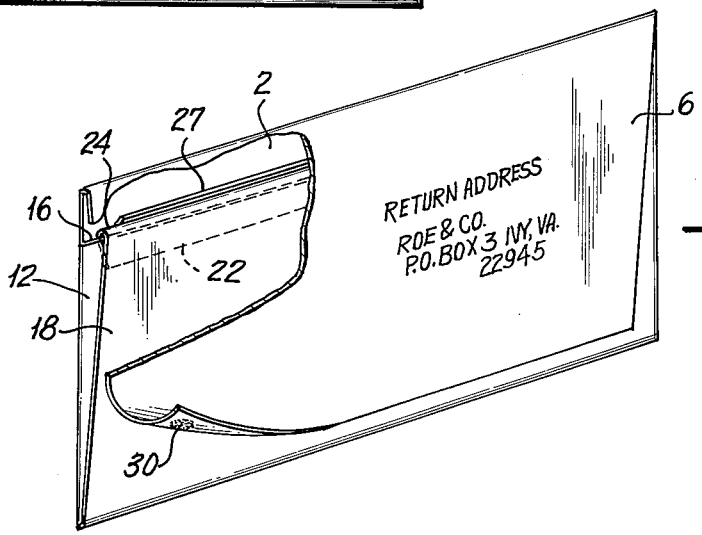
Fig. 4.

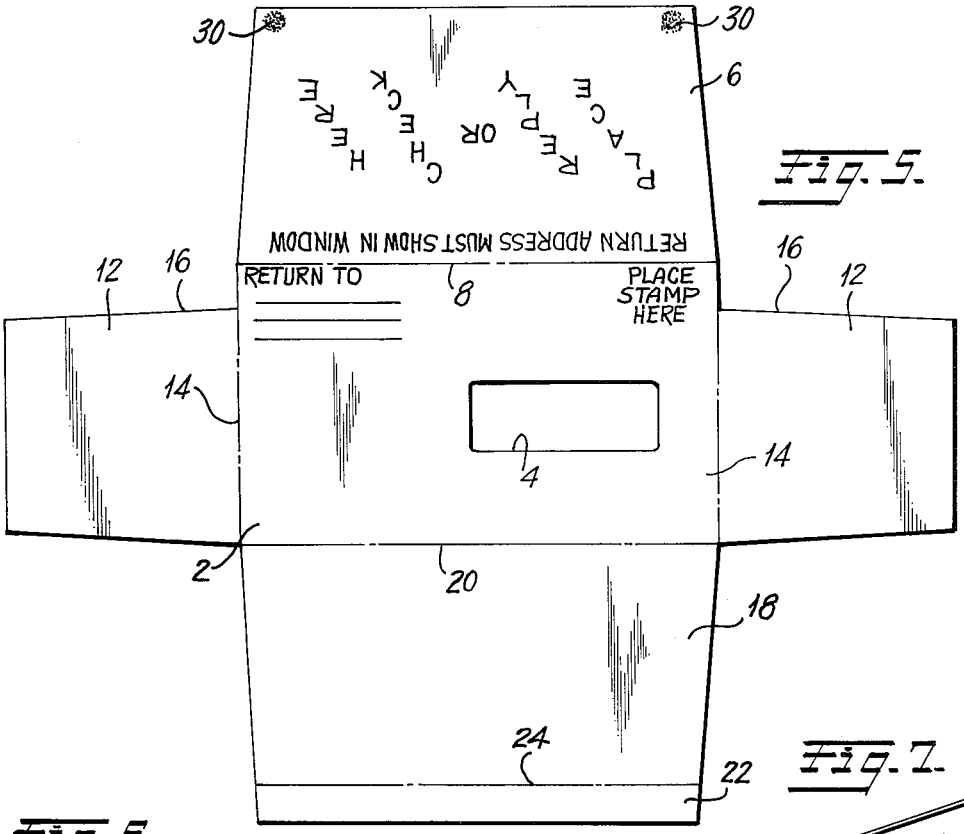
Fig. 5.
Fig. 6.
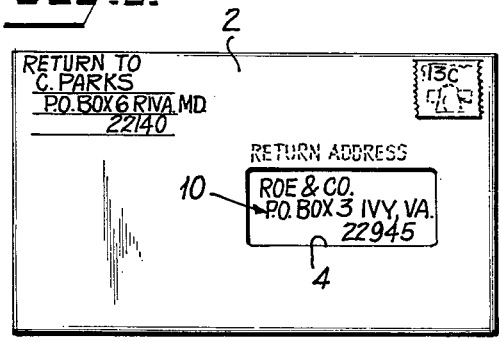
Fig. 7.
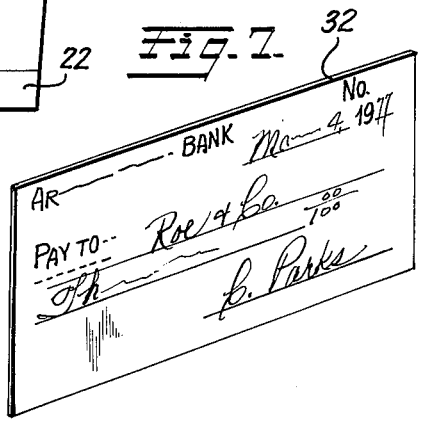
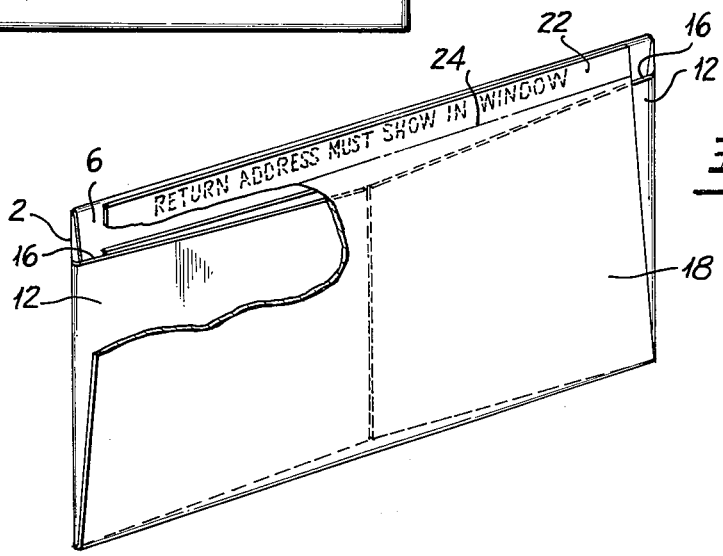
Fig. 8.

RETURNABLE MAIL ENVELOPE

BACKGROUND OF THE INVENTION

This invention is in the field of stationery and particularly envelopes adapted for first and second mailings.

It is common practice for a company or advertiser to send a bill or other enclosures to an addressee and enclose a separate return envelope. Such practice is uneconomical, wasteful and adds materially to the bulk of mail to be handled. It has been proposed before to provide a mailing piece or envelope adapted to contain an enclosure, such as a bill to be paid, wherein the same envelope can be reused for return of an enclosure to the sender. In many instances, the envelope was adapted to be refolded to a different configuration for the return mailing. Such prior proposals, however, were quite complicated and involved adhesive securement for the first mailing in a manner necessitating cutting or tearing the paper before refolding the same to a form for return. Examples of such prior devices are U.S. Pat. Nos. 1,145,935, 1,405,131, 1,960,054, 3,084,846 and 3,113,716.

SUMMARY OF THE INVENTION

The present invention involves a novel and simple blank form having a main panel and flaps or panels foldable from each of the edges thereof. In one form of the invention a viewing window is provided in the main panel through which an address on an enclosure is visible or, for return mailing, one of the flaps is folded to a position behind the window to present a return address for the second mailing. A novel arrangment is provided wherein an edge of one of the foldable panels is folded over edges of underlying flaps to hold the envelope in temporarily closed condition for its first mailing, without the use of adhesives between the parts. The folded strip of the one flap, however, is provided with a moisture actuated adhesive for permanently sealing the envelope for return mailing. In another form of the invention, the viewing window is omitted and the envelope can be refolded for return mailing with the return address either preprinted on one of the panels or hand written of a face of the main panel.

BRIEF DESCRIPTION OF THE DRAWINGS

FIG. 1 is a view of one face of a blank showing a preferred form of the invention;

FIG. 2 is a front view of the envelope when folded and prepared for its first mailing;

FIG. 3 is a perspective view of a representative enclosure in the envelope of FIG. 2;

FIG. 4 is a perspective view, with parts broken away, of the envelope prepared for its first mailing;

FIG. 5 is a view of the same blank shown in FIG. 1 but showing the other face thereof;

FIG. 6 illustrates the mailing piece when prepared for return mailing;

FIG. 7 is a perspective view of a typical enclosure for the second mailing; and

FIG. 8 is a view similar to FIG. 4 but showing the envelope prepared for remailing.

DESCRIPTION OF THE PREFERRED EMBODIMENTS

Referring to FIG. 1, the blank comprises a main or front panel 2 of paper or the like which may be provided with a sight opening or window 4 therein. The window 4 may be a simple opening in the panel or may be a transparent portion, all as well known in the art. A first or top panel 6 is foldably joined to the upper edge of the main panel 2 along score or fold line 8 and may be provided with a printed return address 10 thereon in position to appear through the window 4 when the panel 6 is folded upwardly (as seen in FIG. 1), then downwardly, to overlie the main or front panel 2. An end flap 12 is foldably joined to each end of the main panel 2 along score or fold lines 14. Each of the flaps 12 is shown as approximately one-half the length of the main panel 2 and, as shown, the upper edges 16 thereof are spaced downwardly from the score or fold line 8 at the top of the main panel. Foldably joined to the bottom edge of the main panel 2 is a second or bottom panel 18, joined to the main panel along score or fold line 20. The lower edge of the flap 18 is defined by an integral strip 22 joined to the flap 18 along a further score or fold line 24. As shown in FIG. 1, the strip 22 is provided with a coating of moisture activated adhesive 26 on the uppermost face of the blank as seen in FIG. 1. By "moisture actuated" adhesive applicant intends to refer to adhesives that normally will not adhere well unless prepared by moistening with water or any other liquid and may even include a pressure sensitive adhesive covered by a non-stick strip that may be removed.

FIG. 3 illustrates an example of an enclosure 27 to be enclosed in the envelope for its first mailing and may consist of a bill or statement to be sent to a customer, with or without other enclosures, whose name and address appears on the statement, as at 28. The statement may be placed against the main panel 2, on the under side of the blank, as seen in FIG. 1, so that the address 28 appears through the window 4, as seen in FIG. 2. Thereafter the end flaps 12 are folded rearwardly to embrace the enclosure and the bottom panel 18 is folded rearwardly and upwardly to overlie the back of the flaps 12. As seen in FIG. 4, the strip 22 is then folded inwardly and downwardly to extend inwardly over the upper edges 16 of flaps 12 to loosely hold the envelope in closed condition. At this time the adhesive 26 is not activated and no adhesion between the parts takes place for this first mailing. Finally, the upper panel 6 is folded downwardly to close the rear of the envelope and is temporarily adhered to the outer surface of the bottom panel 18 by spots 30 of adhesive or by any other suitable means. Any suitable means for temporarily holding the envelope thus closed may be employed.

When prepared as described above, the envelope is mailed in the usual manner to the addressee appearing at 28 on the enclosure. When the first addressee receives the mailing, he may open the enveope by separating the panel 6 from the back of the envelope without tearing or destroying the same and the envelope may be completely unfolded.

The addressee or customer may then prepare his payment check, shown in FIG. 7 at 32, or any other enclosure to be returned to the original sender. To prepare the envelope for return mailing, the upper panel 6 is folded upwardly and then downwardly, as seen in FIG. 1, to overlie the main panel 2 with the return address 10 appearing through the window 4 as seen in FIG. 6. The customer may then place his enclosure 32 against the rear face of the panel 6 and then fold the end flaps 12 inwardly to overlie his enclosure. The bottom panel 18 may then be folded upwardly as shown in FIG. 8 to overlie the flaps 12 and at this time the adhesive 26 may be actuated and adhered to the upper edge portion of the rear face of panel 6, as shown in FIG. 8. This provides a sealed return envelope for return to the original sender.

Obviously, suitable directions and instructions may be printed on the blank, such as those illustrated and best seen in FIGS. 5 and 8.

It is to be noted that the width of the flaps 12, being less than the length of the score lines 14, provides for an exposed upper portion of the panel 2 when those flaps are folded inwardly for either a first or second mailing. This provides ample room for folding the strip 22 inwardly, as shown in FIG. 4, and also provides an exposed area to which the adhesive 26 may be adhered, as shown in FIG. 8.

For personal use it is not essential that the window 4 be provided, the main panel 2 may be imperforate and left blank on both faces if desired. In such cases, the envelope may be folded as shown in FIG. 4 for first mailing, the sender either writing his personal message on the inner face of the blank or inserting an enclosure such as a letter or the like. He may then write or otherwise provide the address for the first mailing on the then outer face of panel 2. The addressee may then refold the envelope to the form shown in FIG. 8 for remailing and provide his own enclosure or letter. When the envelope is folded as shown in FIG. 8, the outer face of the panel 2 is the face opposite that that was outermost during the first mailing and thus provides a clean area for the second address.

While specific examples of the invention have been shown and described, the same are merely illustrative of the principles involved and other forms may be resorted to within the scope of the appended claims.

I claim:

1. A blank for a returnable mail envelope comprising:

a sheet of material having a main rectangular panel;

a first panel foldably hinged to a first side edge of said main panel;

end flaps foldably hinged to the end edges of said main panel and having side edges spaced throughout their lengths from said first side edge of said main panel and generally parallel thereto;

a second panel foldably hinged to said main panel along a second side edge thereof opposite said first panel, said second panel having an outer edge portion comprising a strip foldable along a score line parallel to the side edges of said main panel and having a moisture activatable adhesive thereon on one face of said blank, the width of said second panel from said second side edge to said score line being substantially equal to the width of said end flaps along said end edges; and releasable adhesive means on said first panel, on the other face of said blank.

2. An envelope comprising:

a sheet of material defining a rectangular main panel;

end flaps folded from opposite ends of said main panel to overlie said main panel, said end flaps having upper edges spaced downwardly from the upper edge of said main panel to expose the upper portion thereof;

a bottom panel folded upwardly from the bottom edge of said main panel and overlying said end flaps, the upper edge portion of said bottom panel being folded inwardly over the upper edges of said end flaps and downwardly to extend loosely between said end flaps and main panel and defining an openable pocket adapted to receive an enclosure, said edge portion of said bottom panel having a moisture activatable adhesive on the surface thereof facing said main panel;

a top panel folded downwardly from the upper edge of said main panel to overlie the rear face of said bottom panel; and a releasable adhesive securing said top panel to said bottom panel.

* * * * *